US009174108B2

(12) United States Patent
Siklosi et al.

(10) Patent No.: US 9,174,108 B2
(45) **Date of Patent: *Nov. 3, 2015**

(54) FREE STANDING TRAINING BAG WITH TRIPOD BASE

(71) Applicant: Century, LLC, Oklahoma City, OK (US)

(72) Inventors: Tibor Siklosi, Norman, OK (US); Kurt Hafeken, Edmond, OK (US); Jeffrey Woodson, Choctaw, OK (US)

(73) Assignee: Century, LLC, Oklahoma City, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/758,269

(22) Filed: Feb. 4, 2013

(65) Prior Publication Data

US 2014/0221171 A1 Aug. 7, 2014

(51) Int. Cl.

| | |
|---|---|
| ***A63B 69/34*** | (2006.01) |
| ***A63B 69/00*** | (2006.01) |
| ***A63B 69/20*** | (2006.01) |
| *A63B 71/02* | (2006.01) |

(52) U.S. Cl.

CPC ..... *A63B 69/004* (2013.01); *A63B 69/20* (2013.01); *A63B 2071/026* (2013.01); *A63B 2209/00* (2013.01); *A63B 2210/50* (2013.01)

(58) Field of Classification Search

CPC .... A63B 69/004; A63B 69/34; A63B 69/345; A63B 69/201; A63B 69/208

USPC ..... 482/83, 85, 86, 87, 89, 90

See application file for complete search history.

(56) References Cited

U.S. PATENT DOCUMENTS

| | | | | |
|---|---|---|---|---|
| 341,231 | A * | 5/1886 | Goodman | 482/89 |
| 410,475 | A * | 9/1889 | Widger | 482/90 |
| 4,527,796 | A * | 7/1985 | Critelli | 482/86 |
| 6,106,443 | A * | 8/2000 | Kuo | 482/83 |
| 7,357,760 | B1 * | 4/2008 | Rios | 482/90 |
| 7,981,009 | B2 * | 7/2011 | Brenner et al. | 482/83 |
| 2004/0209743 | A1 * | 10/2004 | Perez | 482/83 |
| 2014/0221172 | A1 * | 8/2014 | Siklosi et al. | 482/90 |

* cited by examiner

*Primary Examiner* — Stephen Crow
*Assistant Examiner* — Rae Fischer
(74) *Attorney, Agent, or Firm* — Head, Johnson & Kachigian, P.C.

(57) ABSTRACT

A free standing training bag comprising a base with three legs and an upper body mounted atop the base, where the upper body has at least one striking surface suitable for use in martial arts training. Both the upper body and the base may be padded, allowing the free standing training bag to be used as a combat simulator.

16 Claims, 12 Drawing Sheets

FREE STANDING TRAINING BAG WITH TRIPOD BASE

BACKGROUND OF THE INVENTION

Cross Reference

Not Applicable.

1. Field of the Invention

This invention relates generally to a training bag, and more particularly, but not by way of limitation, to a free standing training bag with a tripod base for use as a combat simulator.

2. Description of the Related Art

The hanging heavy punching bag is one of the earliest forms of punching bag training devices. Hanging heavy bags suffer from several disadvantages, including the limitations presented by the requirement that such a bag must be hung from a ceiling. The installation is permanent, which requires a space within a gym, garage, or home dedicated exclusively for heavy bag training. Furthermore, the hanging heavy bag is designed for boxing and presents functional limitations to martial arts disciplines that employ inside, outside, and front leg kicks.

Free standing training bags were developed as an effective alternative to hanging heavy bags that require physically mounting the hanging bags to structural elements within the ceiling framing members. Free standing punching bags are typically mounted to a heavy base which rests on the ground surface and therefore do not require ceiling installation. Free standing punching bags are typically built upon a large weighted base tilled with water, which may weigh in excess of 275 lbs (125 kg) in order to keep the bag upright during use. Disadvantages of the current free standing bag structures include: the requirement to fill with water, or in some cases sand; the need for a large volume base, which limits the striking surface; and the problem of physically moving the free standing bag.

Functional disadvantages of current free standing bags include a minimum lower striking surface due to the large area required by the base and limitations regarding height. The limited striking surface of free standing bags is particularly limiting to many styles of martial arts or combat sports that employ lower level kicks or strikes. Many free standing bags are height adjustable, which is an impractical feature for a dynamically changing martial arts class.

The large base for existing free standing bags may reach heights of 20 inches (50.8 cm) from the ground which eliminates this area for striking purposes. Additionally, the large base presents a formidable hurdle for children or other vertically challenged athletes.

Additionally, no invention has effectively produced a fight simulator which reflects an opponent's legs as targets as in a standing sparring position.

Based on the foregoing, it is desirable to provide a free standing bag that eliminates the need for a heavily weighted base, eliminates the need for filling with water, is easy to move, and provides a striking geometry that closely reflects the upper body and leg targets such that it satisfies the training needs for all martial arts or combat sport disciplines.

SUMMARY OF THE INVENTION

In general, in a first aspect, the invention relates to a free standing training bag comprising a base with a plurality of legs and an upper body mounted atop the base, where the upper body has at least one striking surface suitable for use in martial arts training. The base may have three legs. The base and upper body may be at least partially padded. The legs may be capable of being folded for storage.

Each of the legs may comprise an internal structure element surrounded by padding. The internal structure elements may be made of plastic, metal, or other rigid but flexible material. The padding may be polyethylene or EVA foam or other strike-absorbing material. Each of the legs may be wrapped in vinyl or other fabric. Each of the legs may terminate in a foot, and the foot may be weighted.

The base may have a top, and each of the internal structure elements may protrude from the top of the base. Each of the internal structure elements may have a bend located above the top of the base such that the three internal structure elements are capable of being placed adjacent each other above the bend to form a center post with the three legs extending downward therefrom at an angle to form a stable tripod. The free standing training bag may further comprise a locating bracket extending from the top of the base such that the internal structure elements may lie against the locating bracket. The free standing training bag may further comprise a cap atop the center post.

The upper body may have an internal void capable of receiving the center post. The upper body may be cylindrical, and the base may have a top that is cylindrical, where the top of the base and the upper body each have a circumference and the circumferences are generally equal. The upper body may be joined to the base via an attachment device, which may be a zipper. The upper body may further comprise at least one laterally projecting striking surface. The upper body may further comprise at least one internal support. The upper body may comprise polyethylene foam wrapped in vinyl or other fabric.

Other advantages and features will be apparent from the following description and from the claims.

DETAILED DESCRIPTION OF THE INVENTION

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. it is understood that the devices and methods are not limited to the embodiments set forth herein for purposes of exemplification.

Figure 1:
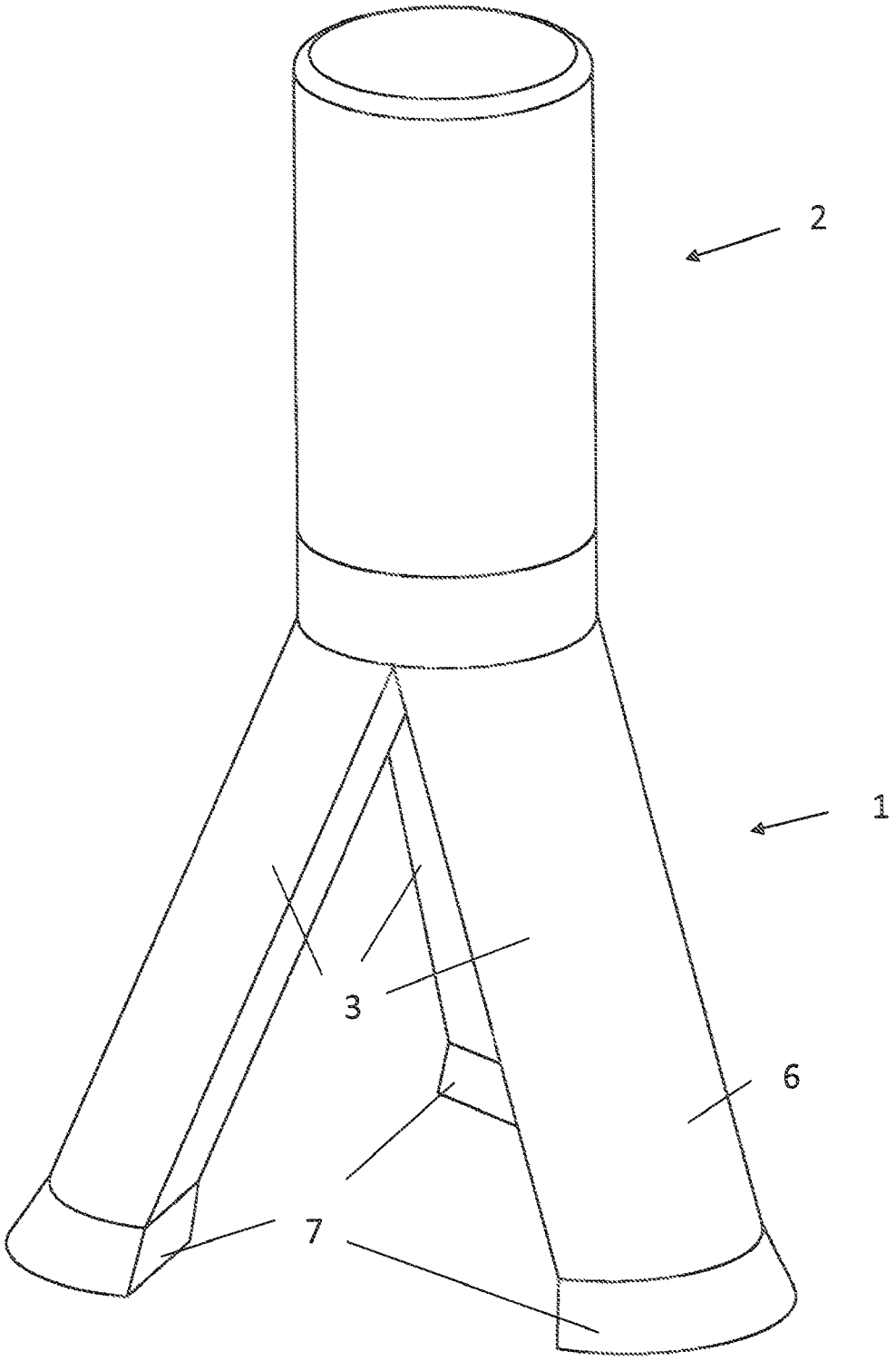
FIG. 1 is a perspective view of the free standing training bag with tripod base.

In general, in a first aspect, the invention relates to a free standing punching and kicking bag built upon a tripod base. The free standing training bag may be used as a combat simulator. As seen in FIG. 1, the free standing training bag may be comprised of two primary parts: a lower body comprised of a padded tripod base 1 and an upper body 2 comprised of a padded cylindrical striking target.

Figure 4:
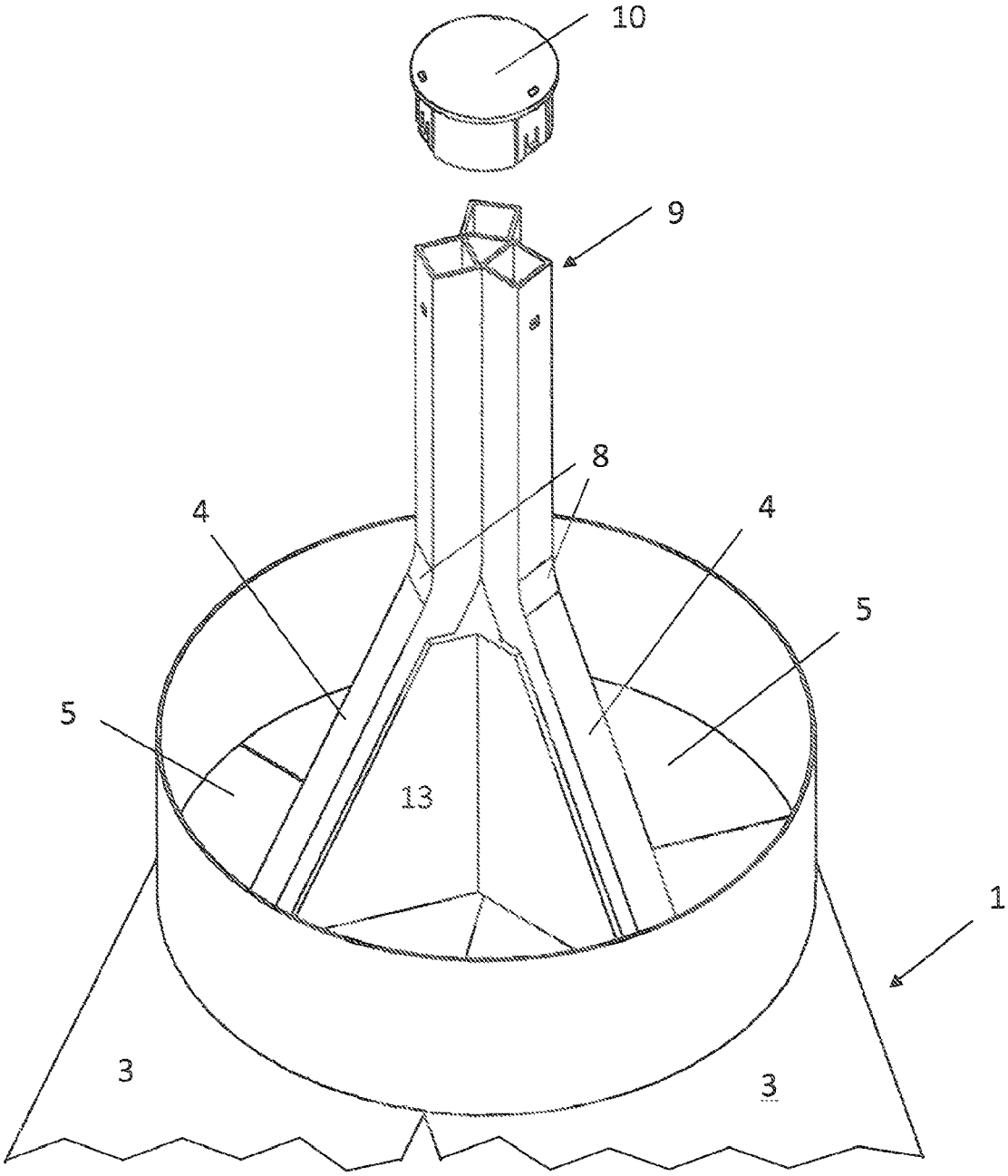
FIG. 4 is a close up perspective view of the top of the base of the free standing training bag, showing the cap ready to apply to the base.

The tripod base 1 may be constructed internally of three independent posts or legs 3. Each leg 3 may have an internal structure element 4. The internal structure elements 4 may be made of polypropylene, polyethylene, PVC, other plastic, metal, or other rigid but flexible material. Each internal structure element 4 may be surrounded by padding 5, as seen in FIG. 4, and the padding 5 may he polyethylene or EVA foam or other strike-absorbing material. Each of the legs 3 may be wrapped in an outer skin 6 of vinyl or other fabric. Each leg 3 may terminate in a foot 7, which may be weighted.

Figure 2:
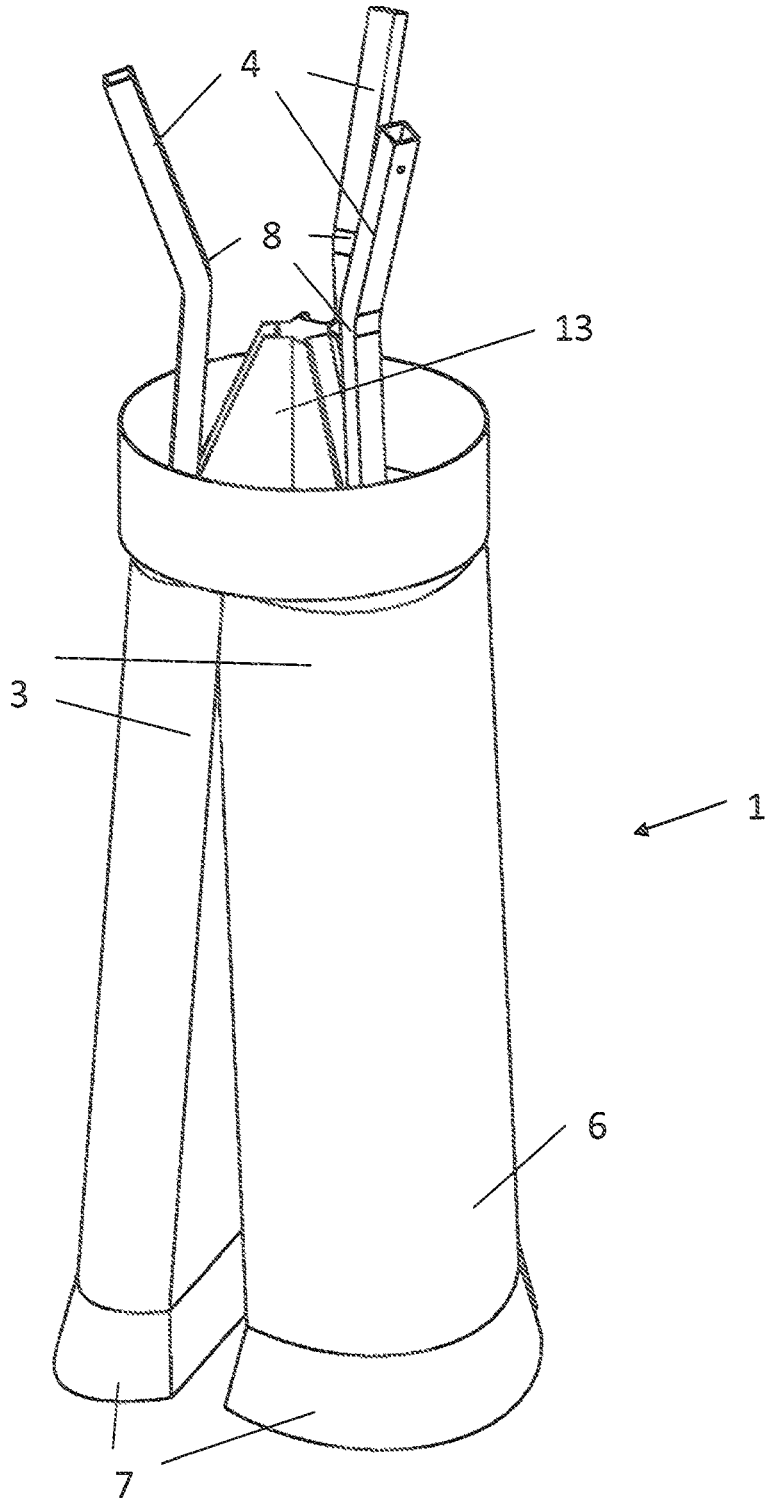
FIG. 2 is a perspective view of the base of the free standing training bag, with the base in a folded position.
Figure 3:
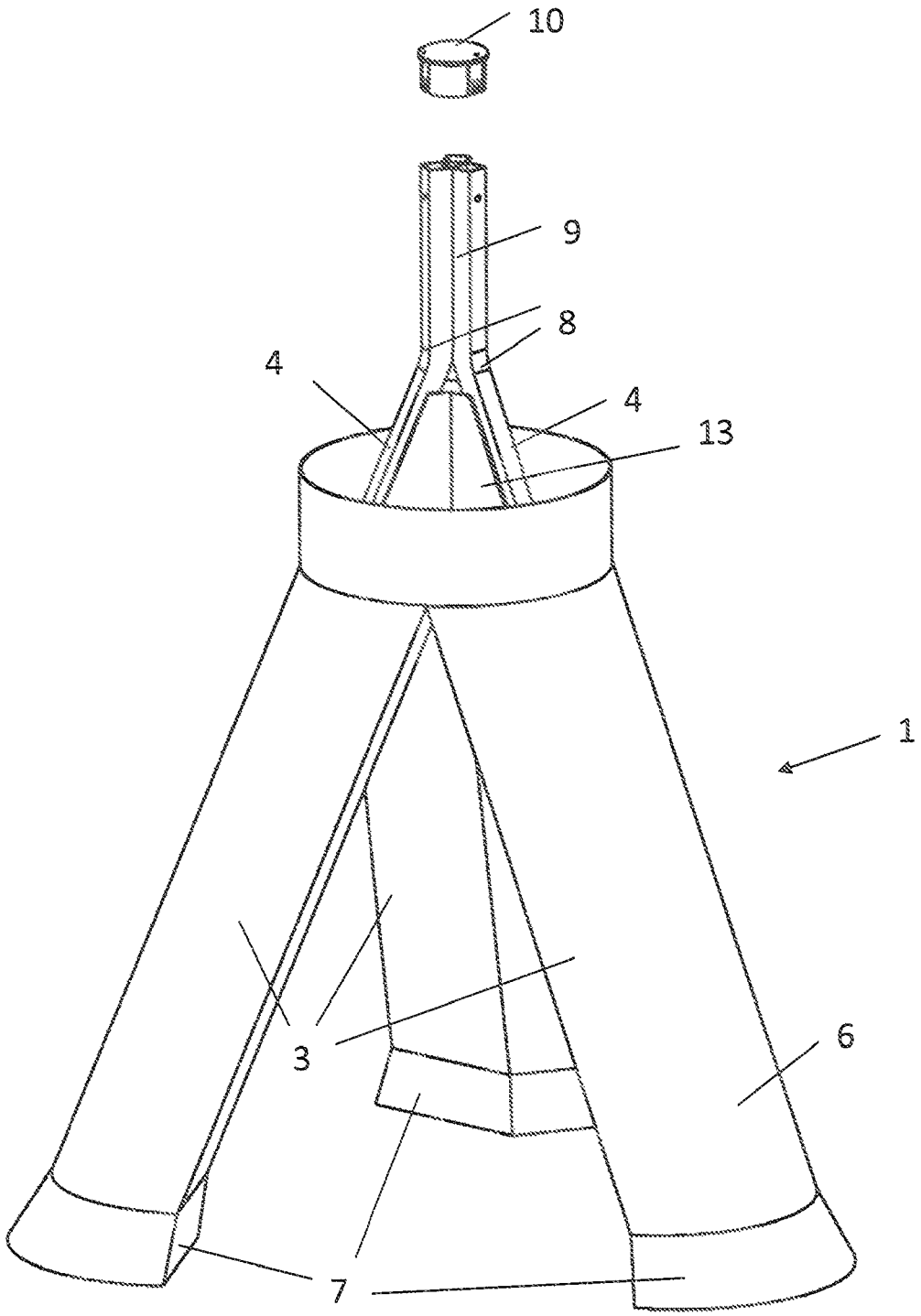
FIG. 3 is a perspective view of the base of the free standing training bag, with the base in an unfolded position, showing the cap ready to apply to the base.
Figure 5:
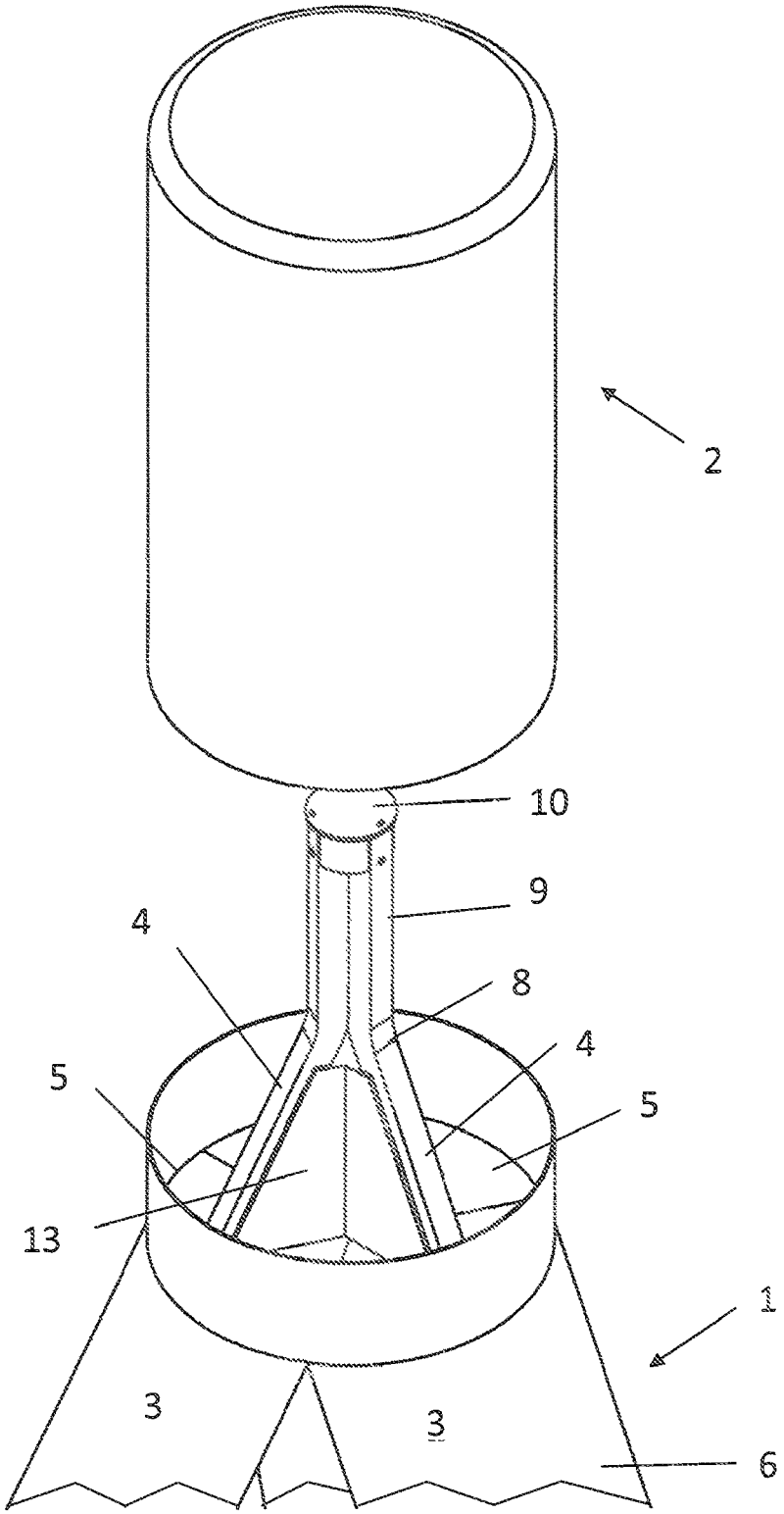
FIG. 5 is a close up perspective view of the top of the base of the free standing training bag, showing the upper body ready to apply to the base.
Figure 6:
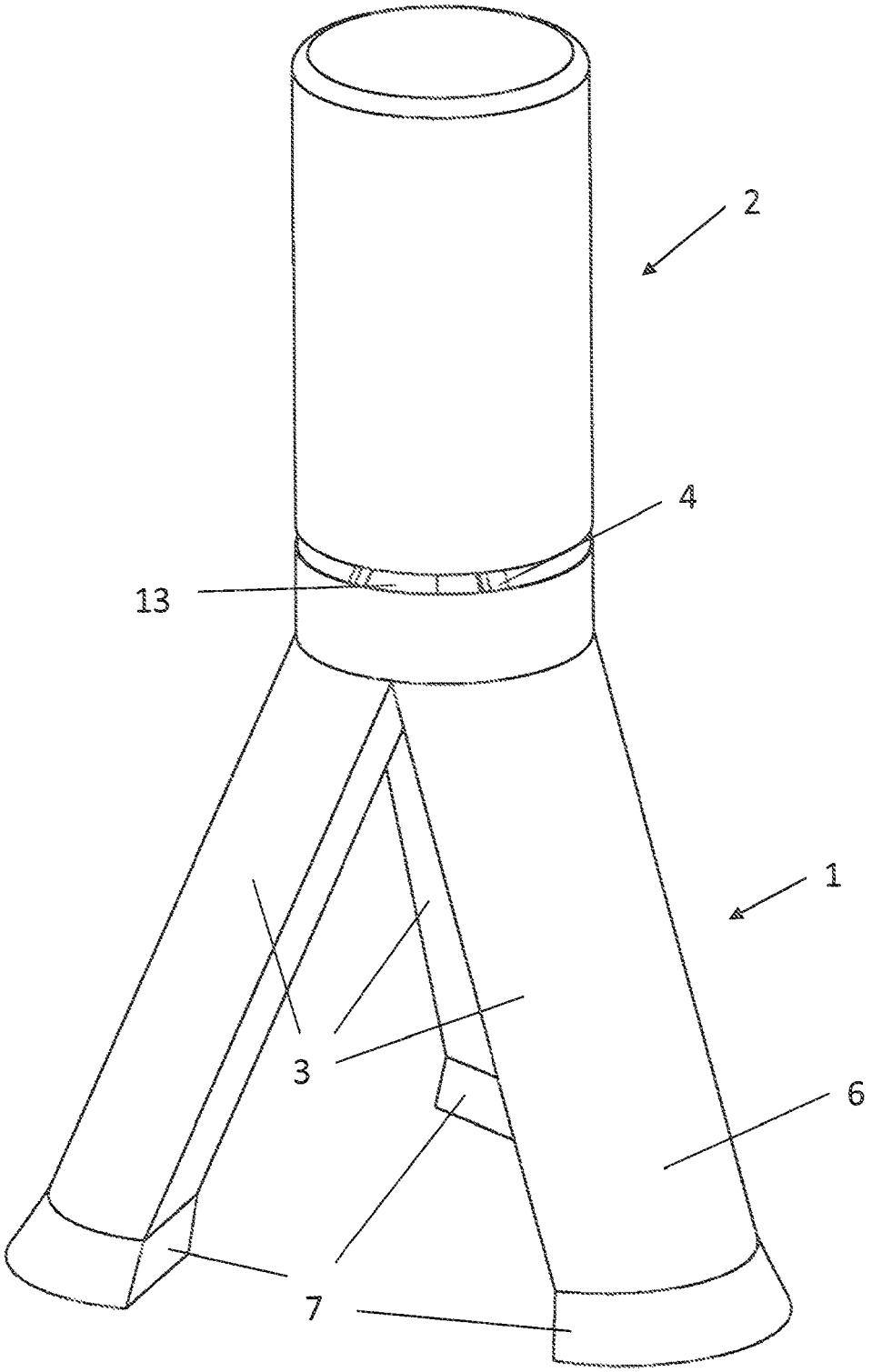
FIG. 6 is a perspective view of the free standing training bag with the upper body partially installed on the base.

The base 1 may be assembled such that the three legs 3 may swing together in a closed position for shipping and/or storage, as seen in FIG. 2. The legs 3 may then be opened to form a stable base when in use. The internal structure elements 4 may protrude from the center of each leg 3 at the top of the base 1, and each internal structure element 4 may have a bend 8 located between the top of the leg 3 and the end of the internal structure element 4 such that the three internal structure elements 4 form a center post 9 when the legs 3 are extended in an open position, as seen in FIG. 3. The portion of the legs 3 adjacent the center post 9 may fit into or against a locating bracket 13 when fully extending, where the locating bracket 13 protrudes from the top of the base 1, as seen in FIGS. 2 through 4. The three legs 3 may be held in place in the open position by a cap 10 applied to the top of the center post 9, as seen in FIGS. 3, 4, and 5. The angle of the bend 8, and subsequently of the legs 3 when in the open position, may be any angle desired for optimal stability. This tripod structure may provide a low center of gravity from the broad footprint generated by the three legs 3. Additionally, each leg 3 may be further weighted with sand or another form of weight to further enhance stability.

Figure 7:
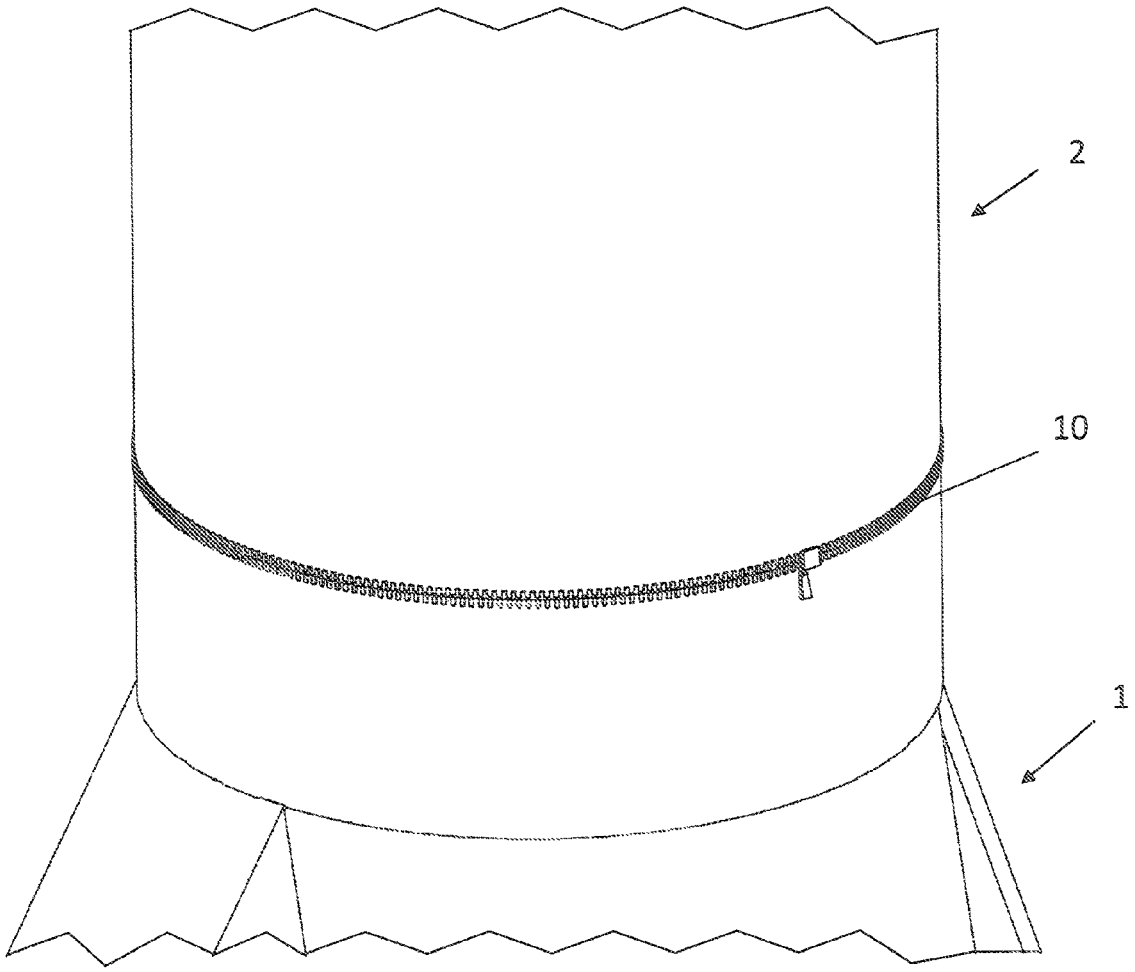
FIG. 7 is a close up perspective view of the optional zipper joining the upper body to the base.

The upper body 2 may be comprised of polyethylene foam wrapped in vinyl. The upper body 2 may be cylindrical or any other desired shape. The upper body 2 may have a void at its center, which serves as a receptacle to receive the center post 9 of the base 1. The center post 9 may help hold the upper body 2 upright and in place during use, while the upper body 2 may in turn help hold the internal structure elements 4 in place as the center post 9. The bottom of the upper body 2 may generally have the same circumference as the top of the base 1, allowing the upper body 2 and the base 1 to form a single unit when the upper body 2 is in place on the base 1. The upper body 2 may be joined to the base 1 via an attachment device, such as a zipper 10 as shown in FIG. 7, hook and loop material, both a zipper and hook and loop material, or any other suitable attachment device.

Figure 8:
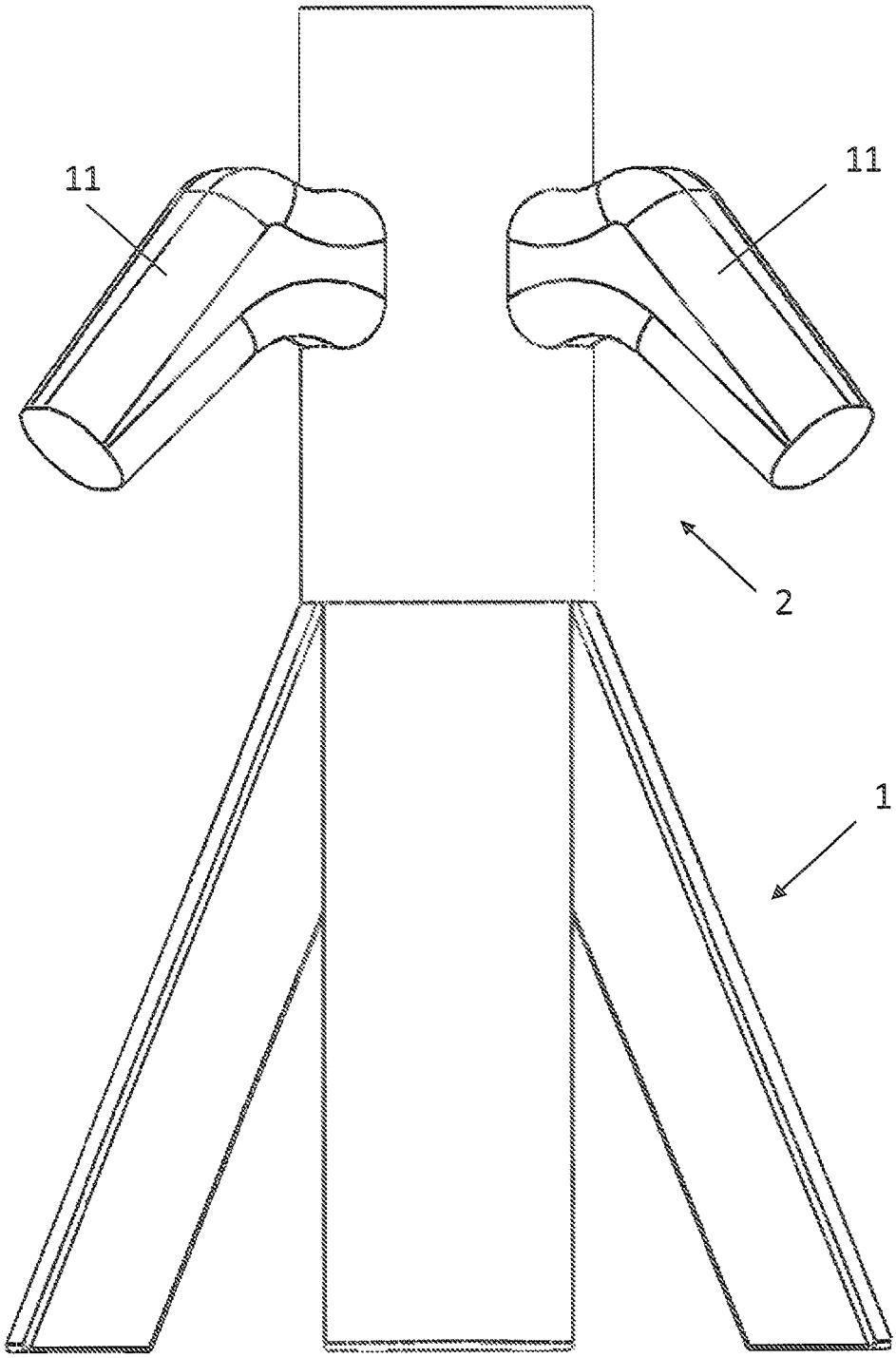
FIG. 8 is a front view of the free standing training bag with optional shoulders and arms in a first configuration.
Figure 9:
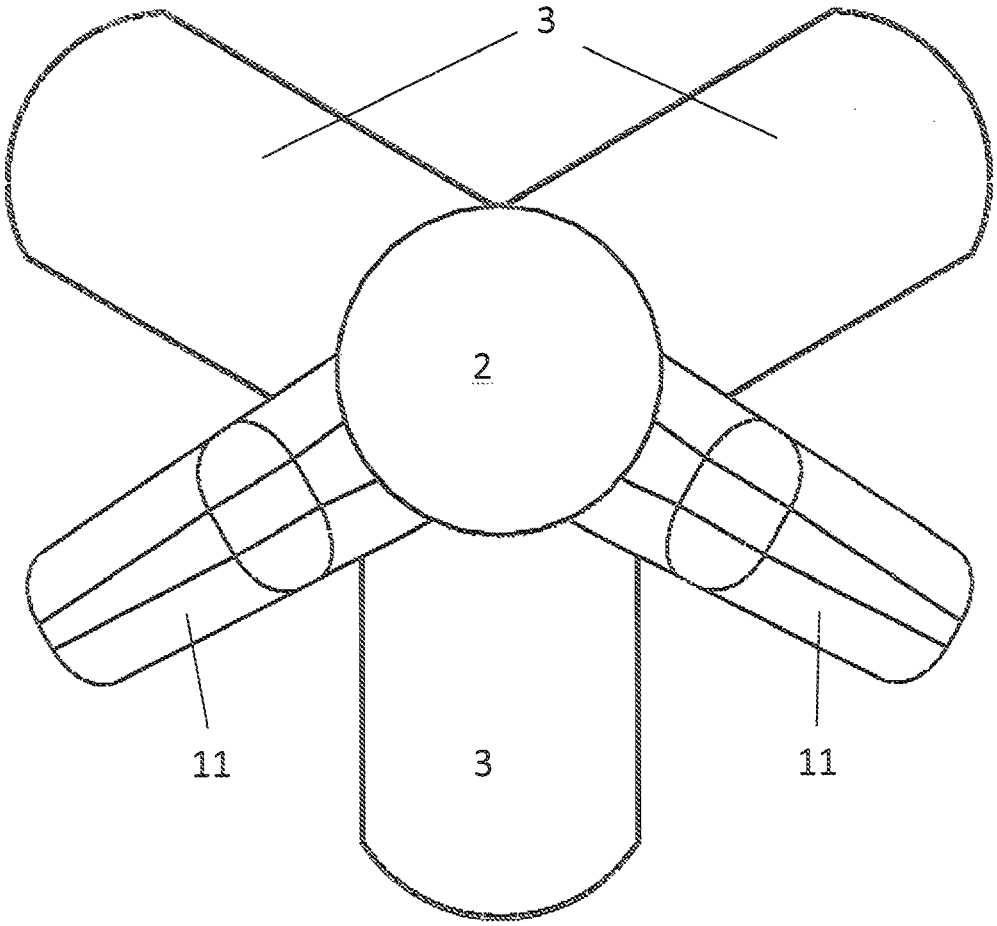
FIG. 9 is a top view of the free standing training bag with optional shoulders and arms in the first configuration.
Figure 10:
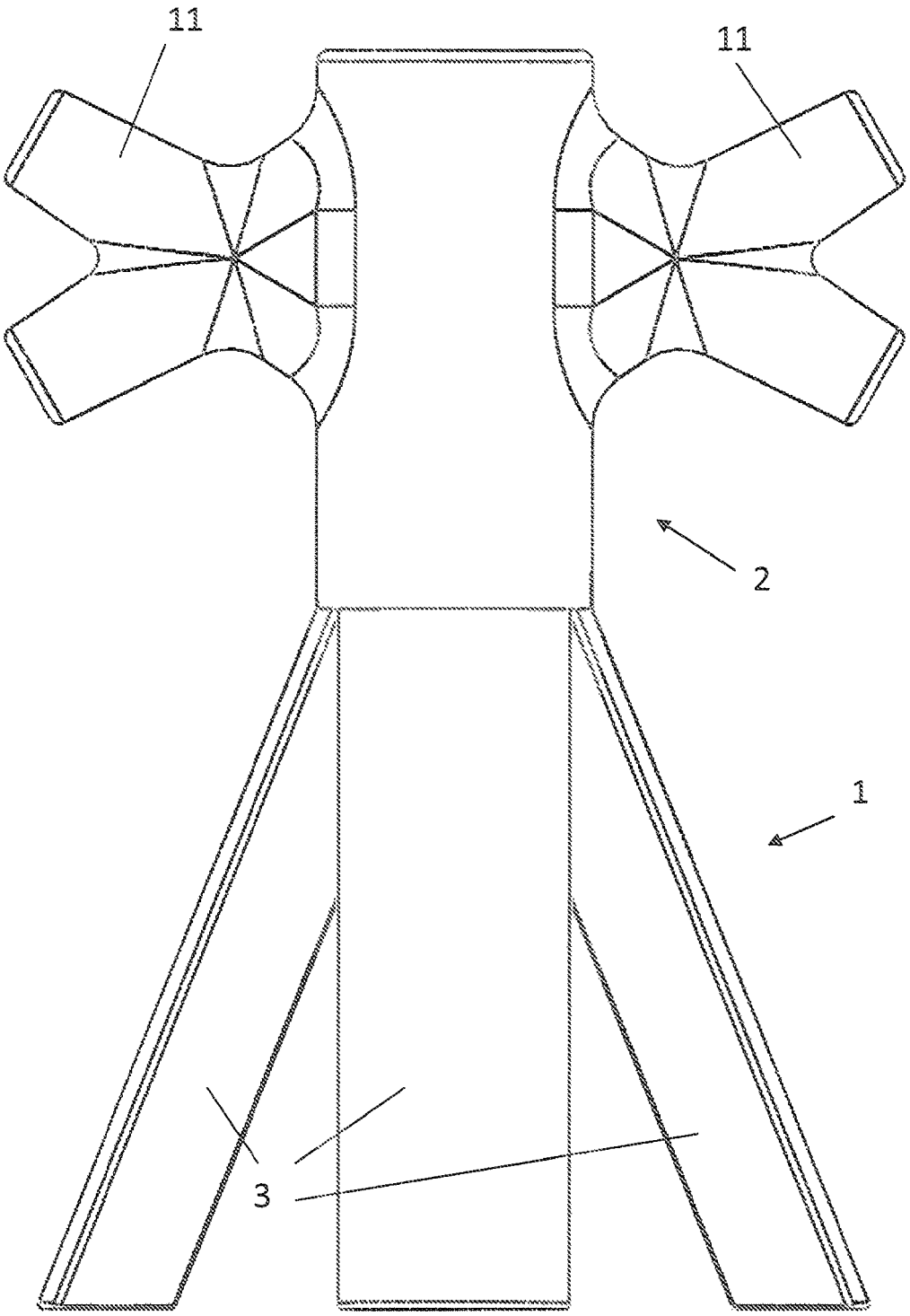
FIG. 10 is a front view of the free standing training bag with optional shoulders and arms in a second configuration.
Figure 11:
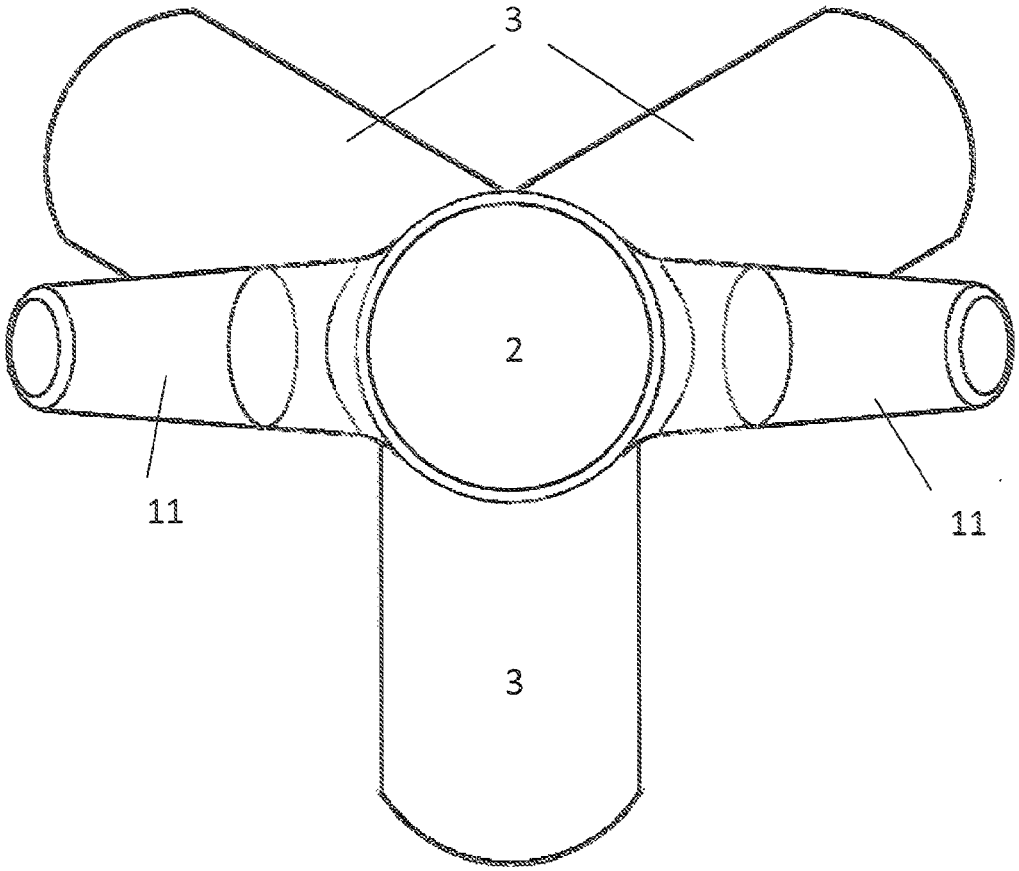
FIG. 11 is a top view of the free standing training bag with optional shoulders and arms in the second configuration.
Figure 12:
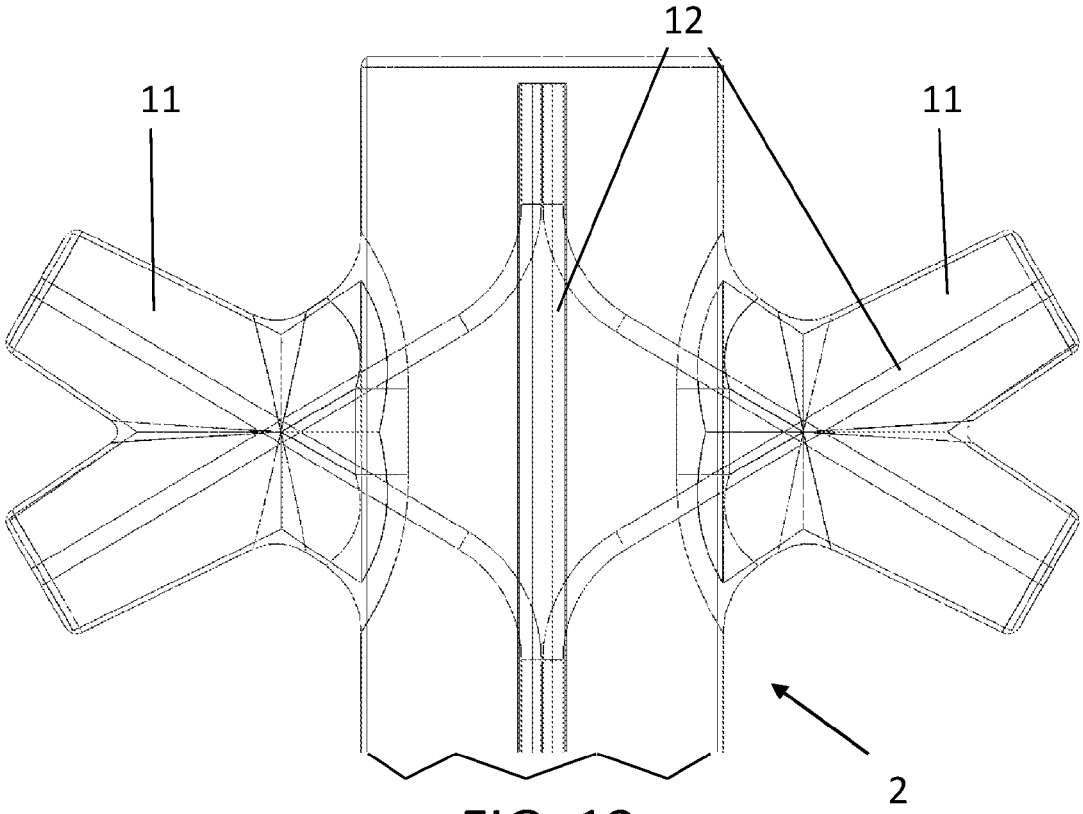
FIG. 12 is a front view of the free standing training bag with optional shoulders and arms with internal posts shown in dashed lines.
Figure 13:
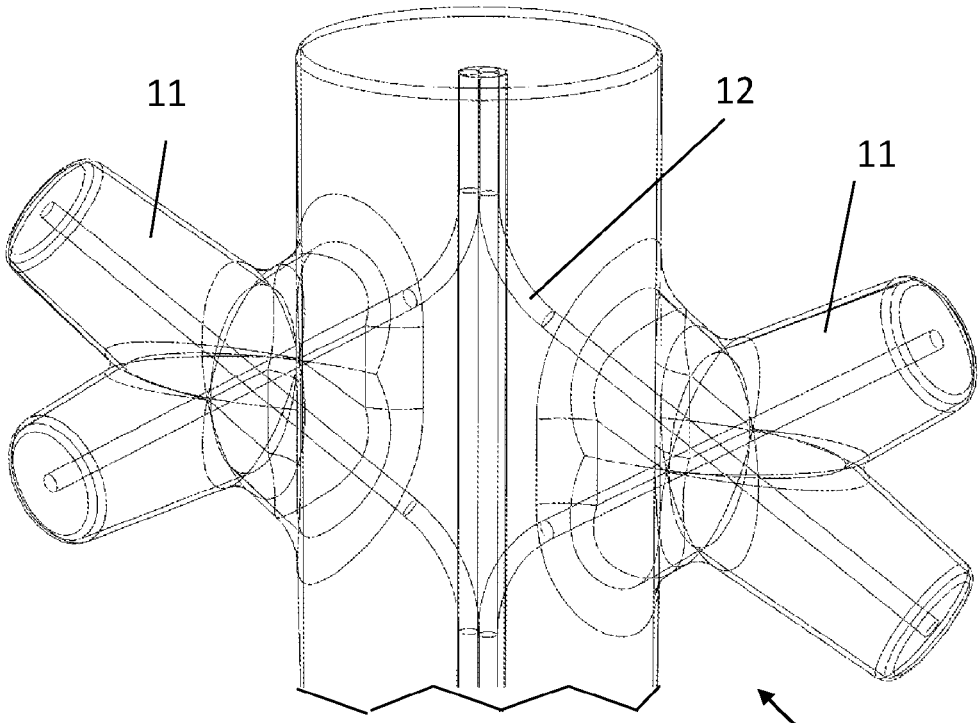
FIG. 13 is a perspective view of the free standing training bag with optional shoulders and arms with internal posts shown in dashed lines.

The free standing training bag may be constructed of various sizes. Larger sizes may accommodate multiple users in a group or class setting, while smaller sizes may be appropriate for individual users. The individual user version may include shoulders and arms 11, as shown in FIGS. 8 and 10, which convert the device into a highly effective grappling or wrestling throwing dummy. The shoulders and arms 11 may have any desired configuration, such as two shoulders and arms 11 configured similar to those of a person, as seen in FIG. 8 and above in FIG. 9, or each may branch out both upward and downward, as seen in FIG. 9 and from above in FIG. 10. The arms and shoulders 11 may be constructed with rigid but flexible internal posts 12, as shown in FIGS. 12 and 13, which enable life-like resistance and structure most closely resembling the body of an opponent.

There are several benefits to the free standing training bag/fight simulator. It may ship in two pre-assembled pieces, which may be shipped together or in two boxes. The lower body legs 1 may fold together, which provides additional freight advantages. The two pre-assembled pieces may be joined together easily by the user without the need for tools or hardware. The product may be pre-loaded with weighted feet 7 and therefore requires no filling with water or sand by the user. The complete assembly may weigh as little as 100 lbs. (45 kg), compared to upwards of 275 lbs. (125 kg) for current free standing bags, which makes them extremely difficult to move. Martial arts schools often move their free standing bags on and off the gym floor several times a day. The minimal weight of the current invention provides martial arts schools the ability to move the training product on and off the gym floor easily. The legs 1 may fold down and together, which provides the school owner or instructor the ability to store the fight simulator when not in use.

The free standing training bag may be considered a true combat simulator that provides both upper body and lower body striking targets. The lower body may allow athletes to perform inside and outside leg kicks in addition to groin kicks or strikes. The legs 1 may be padded down to within 5 inches (12.7 cm) of the floor, which provides a full striking surface, unlike any other product on the market, The scale of the fight simulator may be large enough to accommodate multiple users in a class setting, or may be scaled down for individual athlete training. The smaller individual athlete version may include the addition of shoulders and arms, which meets the needs of grappling, judo, wrestling, and mixed martial arts. The addition of shoulders and arms may allow the free standing training bag to be used as a highly effective practice throwing dummy. The smaller individual grappling and mixed martial arts version may be made to accommodate various size and weights of athletes by varying the size and weight of the fight simulator. The smaller version may also accommodate putting on a Judo Gi jacket, which provides Judo disciplines a specialized and realistic practice throwing dummy.

Whereas, the devices and methods have been described in relation to the drawings and claims, it should be understood that other and further modifications, apart from those shown or suggested herein, may be made within the spirit and scope of this invention.

What is claimed is:

1. A free standing training bag comprising:

a base with a plurality of legs, where the base has at least one striking surface suitable for use in martial arts training, where the legs are capable of being folded downward for storage, where the legs each comprise an internal structure element surrounded by padding, where each of the internal structure elements has a protruding portion protruding upward from the base, and where the protruding portions of the internal structure elements are not connected to each other when the legs are folded; and an upper body mounted atop the base, where the upper body has at least one striking surface suitable for use in martial arts training;

where the free standing training bag is fully padded with foam.

2. The free standing training bag of claim 1 where the base has three legs.

3. The free standing training bag of claim 1 where the internal structure elements are made of plastic, metal, or other rigid but flexible material.

4. The free standing training bag of claim where the padding is polyethylene or EVA foam or other strike-absorbing material.

5. The free standing training bag of claim 1 where each of the legs is wrapped in vinyl or other fabric.

6. The free standing training bag of claim 1 where each of the legs terminates in a weighted foot.

7. The free standing training bag of claim 1 where:

the plurality of legs comprises three legs extending downward; and each of the internal structure elements has a bend located above the base such that the internal structure elements are capable of being placed adjacent each other above the bend to form a center post with the three legs extending downward therefrom at an angle to form a stable tripod.

8. The free standing training bag of claim 7 further comprising a locating bracket extending from the base such that the internal structure elements may lie against the locating bracket.

9. The free standing training bag of claim 7 further comprising a cap atop the center post.

10. The free standing training bag of claim 7 where the upper body has an internal void capable of receiving the center post.

11. The free standing training bag of claim 1 where the upper body is cylindrical.

12. The free standing training bag of claim 11 where the base has a top that is cylindrical and where the top of the base and the upper body each have a circumference and the circumferences are generally equal.

13. The free standing training bag of claim 1 where the upper body is joined to the base via an attachment device.

14. The free standing training bag of claim 13 where the attachment device is a zipper.

15. The free standing training bag of claim 1 where the upper body further comprises at least one laterally projecting striking surface.

16. The free standing training bag of claim 1 where the upper body comprises polyethylene foam wrapped in vinyl or other fabric.

* * * * *